US010340074B2

(12) United States Patent
Chiu et al.

(10) Patent No.: US 10,340,074 B2
(45) Date of Patent: Jul. 2, 2019

(54) TRANSFORMER

(71) Applicant: CYNTEC CO., LTD., Hsinchu (TW)

(72) Inventors: Kuan-Yu Chiu, Hsinchu (TW); Chu-Keng Lin, Hsinchu (TW); Hsieh-Shen Hsieh, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 143 days.

(21) Appl. No.: 15/367,194

(22) Filed: Dec. 2, 2016

(65) Prior Publication Data

US 2018/0158597 A1 Jun. 7, 2018

(51) Int. Cl.

| | |
|---|---|
| ***H01F 27/30*** | (2006.01) |
| ***H01F 27/32*** | (2006.01) |
| ***H01F 27/24*** | (2006.01) |
| *H01F 27/28* | (2006.01) |

(52) U.S. Cl.

CPC ..... *H01F 27/323* (2013.01); *H01F 27/24* (2013.01); *H01F 27/306* (2013.01); *H01F 27/324* (2013.01); *H01F 27/2823* (2013.01)

(58) Field of Classification Search

USPC ..... 336/206

See application file for complete search history.

(56) References Cited

U.S. PATENT DOCUMENTS

| | | | | |
|---|---|---|---|---|
| 5,267,138 | A | 11/1993 | Shores | |
| 6,867,674 | B1 * | 3/2005 | Schutte | H01F 27/2823 336/180 |
| 8,289,121 | B2 * | 10/2012 | Yan | H01F 17/045 29/602.1 |
| 2002/0190830 | A1 * | 12/2002 | Matsumoto | H01F 3/10 336/83 |
| 2003/0193384 | A1 * | 10/2003 | Yang | H01F 17/045 336/65 |
| 2015/0325357 | A1 * | 11/2015 | Yamaguchi | H01F 27/24 336/65 |

FOREIGN PATENT DOCUMENTS

| | | | |
|---|---|---|---|
| CN | 1279811 | A | 1/2001 |
| CN | 102428526 | A | 4/2012 |
| CN | 103426612 | A | 12/2013 |
| CN | 105097178 | A | 11/2015 |
| TW | 318246 | | 10/1997 |
| TW | I492250 | B | 7/2015 |
| TW | M521253 | U | 5/2016 |
| TW | I555045 | B | 10/2016 |
| TW | M531038 | U | 10/2016 |

* cited by examiner

*Primary Examiner* — Ronald Hinson
(74) *Attorney, Agent, or Firm* — Winston Hsu

(57) ABSTRACT

A transformer comprises a first core, a second core, a plurality of electrodes, an inner winding and an outer winding. The first core has a central hole. The second core is disposed in the central hole. The second core has two flanges and a pillar located between the two flanges. The inner winding is wound around the pillar. A first winding end of the inner winding is electrically connected to one of the electrodes. The inner winding comprises a first wire and a first insulating layer covering the first wire. The outer winding is wound around the inner winding. A second winding end of the outer winding is electrically connected to one of the electrodes. The outer winding comprises a second wire and a second insulating layer covering the second wire. Second thickness of the second insulating layer is larger than first thickness of the first insulating layer.

13 Claims, 12 Drawing Sheets

TRANSFORMER

BACKGROUND OF THE INVENTION

1. Field of the Invention

The invention relates to a transformer and, more particularly, to a transformer capable of increasing withstand voltage effectively.

2. Description of the Related Art

A transformer is an important electric component used for increasing or decreasing voltage. In most of circuits, there is always a transformer installed therein. In general, the transformer usually consists of a primary winding, a secondary winding and a core. In the related art, the primary winding is wound around a pillar of the core and the secondary winding is wound around the primary winding. Since the transformer is requested to be miniaturized, a winding space for the primary winding and the secondary winding is limited. To avoid generating a flash over due to insulation breakdown between the primary winding and the secondary winding, the related art disposes an insulating tape between the primary winding and the secondary winding. However, the insulating tape occupies the winding space, such that an outer diameter of the whole winding will increase. Consequently, the process of manufacturing the transformer will get complicated and the manufacturing cost will increase. Besides, the insulating tape still cannot ensure that the flash over can be avoided well while a withstand voltage test is performed on the transformer.

SUMMARY OF THE INVENTION

The invention provides a transformer capable of increasing withstand voltage effectively, so as to solve the aforesaid problems.

According to an embodiment of the invention, a transformer comprises a first core, a second core, a plurality of electrodes, an inner winding and an outer winding. The first core has a central hole. The second core is disposed in the central hole. The second core has two flanges and a pillar located between the two flanges. A winding space is located among the two flanges and the pillar. The electrodes are selectively disposed on one of the first core and the second core. The inner winding is wound around the pillar and located in the winding space. A first winding end of the inner winding is electrically connected to one of the electrodes. The inner winding comprises a first wire and a first insulating layer covering the first wire. The outer winding is wound around the inner winding and located in the winding space. A second winding end of the outer winding is electrically connected to one of the electrodes. The outer winding comprises a second wire and a second insulating layer covering the second wire. Second thickness of the second insulating layer is larger than first thickness of the first insulating layer.

As mentioned in the above, since the second thickness of the second insulating layer of the outer winding is larger than the first thickness of the first insulating layer of the inner winding, a withstand voltage of the transformer can be increased effectively by increasing the second thickness of the second insulating layer of the outer winding, so as to avoid generating a flash over between the inner winding and the outer winding. Furthermore, since the invention increases the withstand voltage of the transformer by increasing the second thickness of the second insulating layer of the outer winding, the invention can maintain the volume of the transformer without disposing an insulating tape between the inner winding and the outer winding, such that the process of manufacturing the transformer can be simplified and the manufacturing cost can be reduced. Moreover, since there is no insulating tape disposed between the inner winding and the outer winding, the winding space can be saved for the inner winding and the outer winding, so as to keep flexibility in designing a characteristic of the transformer. In some embodiments, when the transformer of the invention is applied to an electronic product with high voltage, the invention may selectively disposed the insulating tape between the inner winding and the outer winding, so as to further increase the withstand voltage of the transformer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
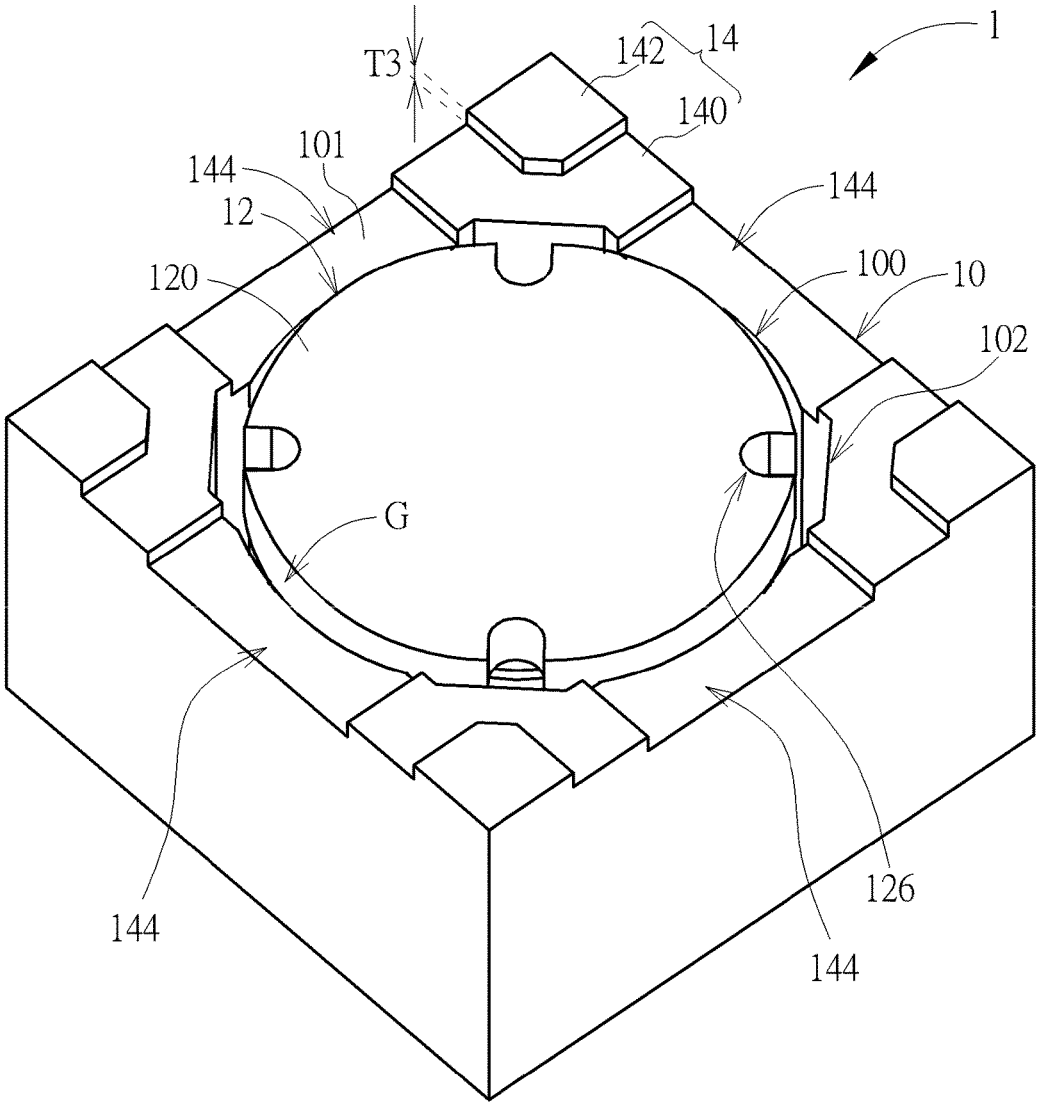
FIG. 1 is a perspective view illustrating a transformer according to an embodiment of the invention.
Figure 2:
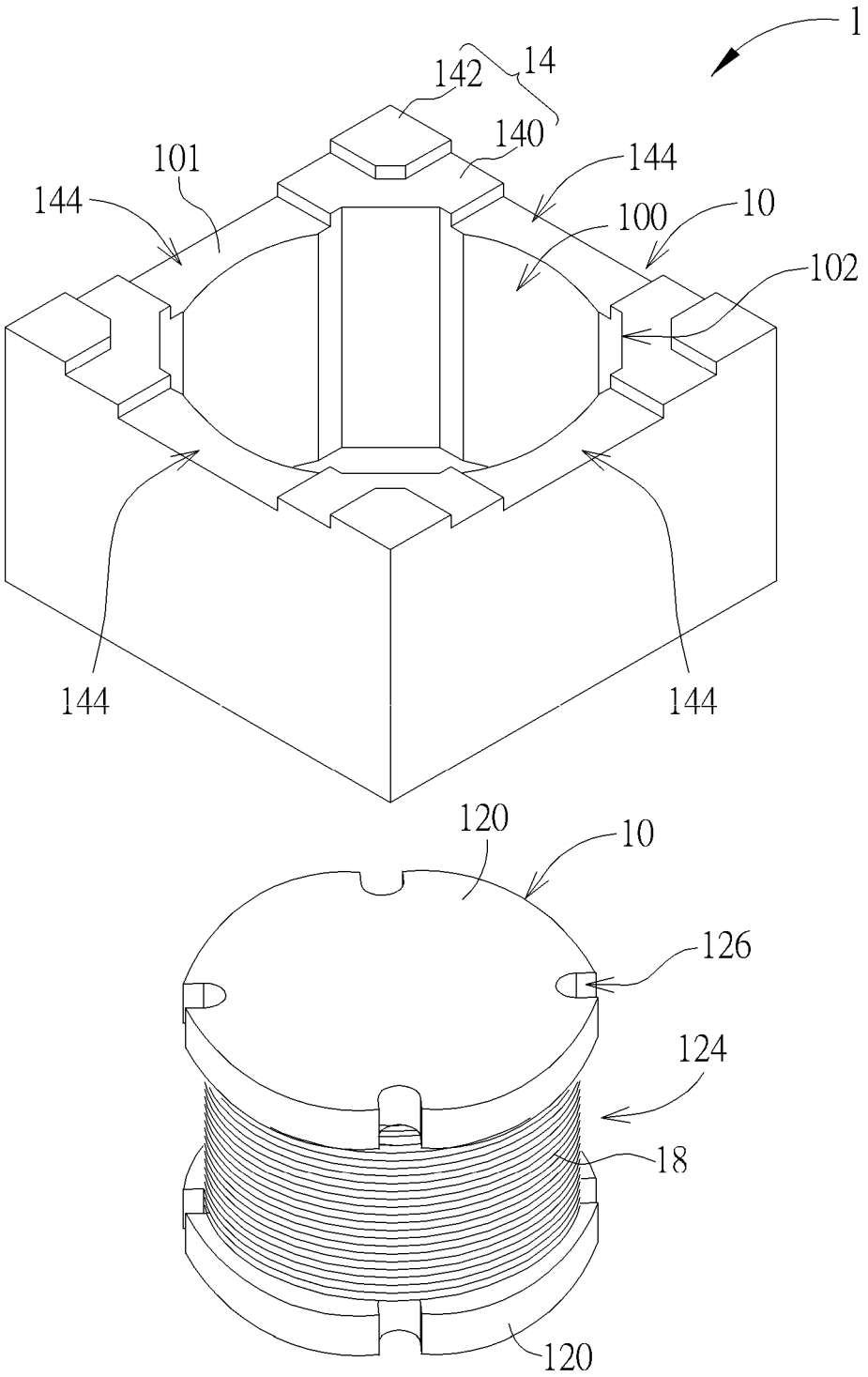
FIG. 2 is an exploded view illustrating the transformer shown in FIG. 1.
Figure 3:
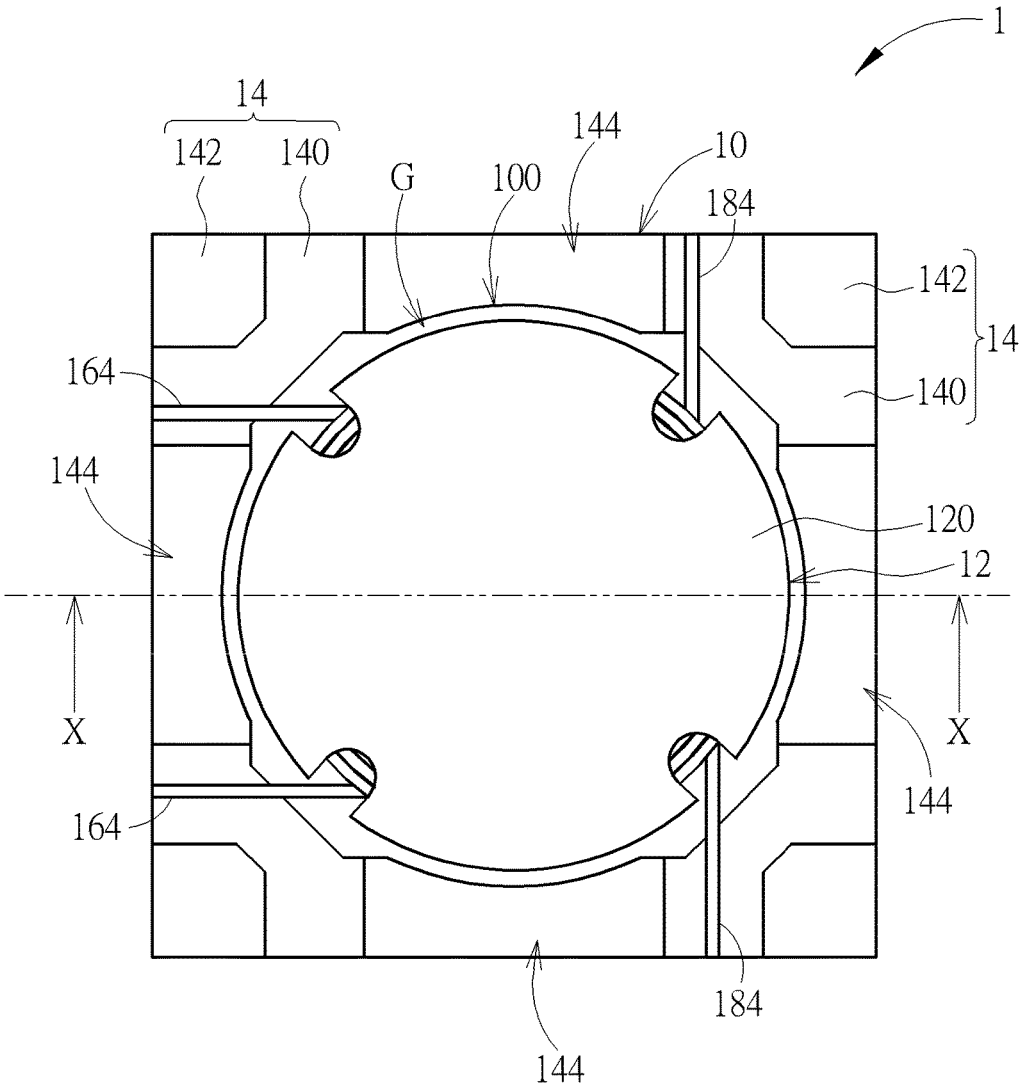
FIG. 3 is a top view illustrating the transformer shown in FIG. 1.
Figure 4:
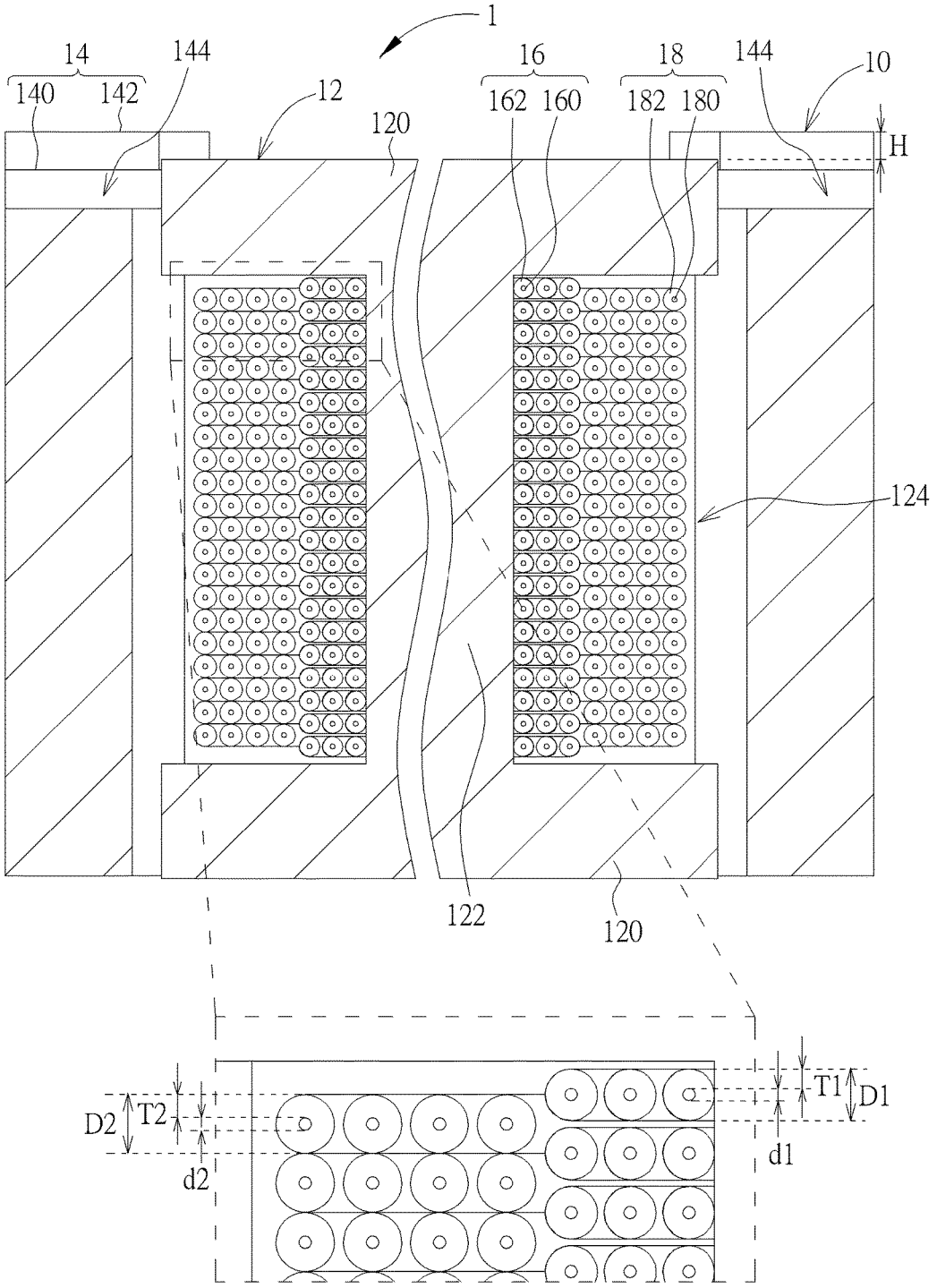
FIG. 4 is a sectional view illustrating the transformer shown in FIG. 1 along line X-X.

Referring to FIGS. 1 to 4, FIG. 1 is a perspective view illustrating a transformer 1 according to an embodiment of the invention, FIG. 2 is an exploded view illustrating the transformer 1 shown in FIG. 1, FIG. 3 is a top view illustrating the transformer 1 shown in FIG. 1, and FIG. 4 is a sectional view illustrating the transformer 1 shown in FIG. 3 along line X-X.

As shown in FIGS. 1 to 4, the transformer 1 comprises a first core 10, a second core 12, a plurality of electrodes 14, an inner winding 16 and an outer winding 18. The first core 10 has a central hole 100. The second core 12 is disposed in the central hole 100. The second core 12 has two flanges 120 and a pillar 122 located between the two flanges 120. A winding space 124 is located among the two flanges 120 and the pillar 122. In this embodiment, the first core 10 may be an SRI (square-ring shape) core and the second core 12 may be a drum core, wherein the first core 10 and the second core 12 may be made of a mixture of Ni and Zn.

The electrodes 14 are disposed on the first core 10. In this embodiment, each of the electrodes 14 has a first platform 140 and a second platform 142, wherein the second platform 142 is higher than the first platform 140. The first platform 140 is protruded from a surface 101 of the first core 10 and the second platform 142 is protruded from the first platform 140, so as to form a ladder-shaped electrode 14. Furthermore, a separation structure 144 exists between two adjacent electrodes 14 to separate the two adjacent electrodes 14 since the first platform 140 is protruded from a surface 101 of the first core 10, wherein the separation structure 144 is non-conductive. In this embodiment, the separation structure 144 may be, but not limited to, a recess structure. The heights of the separation structure 144, the first platform 140 and the second platform 142 are different from each other. That is to say, a height difference exists at a joint between any two of the separation structure 144, the first platform 140 and the second platform 142, wherein the second platform 142 is higher than the first platform 140 and the first platform 140 is higher than the separation structure 144. Accordingly, the invention may coat silver or other conductive materials on four corners of the first core 10 to form four electrodes 14 in one process. Since the electrodes 14 are disposed on the corners of the first core 10, a welding area of each electrode 14 may increase.

In this embodiment, the second platform 142 is a highest structure of the transformer 1, wherein the second platform 142 may be soldered to a circuit board (not shown) by tin or tin alloy. The second platform 142 is higher than the flange 120 and a height difference H exists between the second platform 142 and the flange 120. When the transformer 1 is soldered to the circuit board, the amount of solder may increase and the solder may be accommodated in the space of the height difference H, so as to enhance soldering strength and shock resistance. Furthermore, the first platform 140 is disposed at an edge of the second platform 142 and at least one conducting layer (e.g. silver layer) is formed on surfaces of the first platform. 140 and the second platform 142, wherein the structure from top to bottom may be that the conducting layer is connected to the first platform 140 and the second platform 142 and then a Ni—Sn alloy is connected to the conducting layer. Moreover, the separation structure 144 is lower than the first platform 140 and the second platform 142, such that a short circuit between two adjacent electrodes 14 can be avoided effectively.

The inner winding 16 is wound around the pillar 122 and located in the winding space 124 of the second core 12, wherein the inner winding 16 comprises a first wire 160 and a first insulating layer 162 covering the first wire 160. The outer winding 18 is wound around the inner winding 16 and located in the winding space 124 of the second core 12, wherein the outer winding 18 comprises a second wire 180 and a second insulating layer 182 covering the second wire 180. In this embodiment, the inner winding 16 may be a primary winding and the outer winding 18 may be a secondary winding. However, in another embodiment, the inner winding 16 may be a secondary winding and the outer winding 18 may be a primary winding.

In this embodiment, second thickness T2 of the second insulating layer 182 of the outer winding 18 is larger than first thickness T1 of the first insulating layer 162 of the inner winding 16 (i.e. T2>T1), as shown in FIG. 4. It should be noted that an outer diameter d2 of the second wire 180 of the outer winding 18 may be identical to an outer diameter d1 of the first wire 160 of the inner winding 16 (i.e. d2=d1), such that an outer diameter D2 of the outer winding 18 may be larger than an outer diameter D1 of the inner winding 16 (i.e. D2>D1).

Since the second thickness T2 of the second insulating layer 182 of the outer winding 18 is larger than the first thickness T1 of the first insulating layer 162 of the inner winding 16, a withstand voltage of the transformer 1 can be increased effectively by increasing the second thickness T2 of the second insulating layer 182 of the outer winding 18, so as to avoid generating a flash over between the inner winding 16 and the outer winding 18. Furthermore, since the invention increases the withstand voltage of the transformer 1 by increasing the second thickness T2 of the second insulating layer 182 of the outer winding 18, the invention can maintain the volume of the transformer without disposing an insulating tape between the inner winding 16 and the outer winding 18, such that the process of manufacturing the transformer 1 can be simplified and the manufacturing cost can be reduced. Moreover, since there is no insulating tape disposed between the inner winding 16 and the outer winding 18, the winding space 124 of the second core 12 can be saved for the inner winding 16 and the outer winding 18, so as to keep flexibility in designing a characteristic of the transformer 1. In some embodiments, when the transformer 1 of the invention is applied to an electronic product with high voltage, the invention may selectively disposed the insulating tape between the inner winding 16 and the outer winding 18, so as to further increase the withstand voltage of the transformer 1.

In this embodiment, the invention may use a paint film with high withstand voltage to form the second insulating layer 182 of the outer winding 18. For example, if the withstand voltage of the transformer 1 is requested to be at least larger than 2250 Vdc, the invention may use a paint film with 169.2 Vdc per μm to form the second insulating layer 182 of the outer winding 18, and then the second thickness T2 of the second insulating layer 182 of the outer winding 18 should be at least larger than 13.3 μm (i.e. 2250 Vdc/169.2 Vdc/μm).

As shown in FIG. 3, a first winding end 164 of the inner winding 16 is electrically connected to one of the electrodes 14 and a second winding end 184 of the outer winding 18 is electrically connected to one of the electrodes 14 by soldering or welding. In this embodiment, two first winding ends 164 of the inner winding 16 are electrically connected to two electrodes 14 correspondingly and two second winding ends 184 of the outer winding 18 are electrically connected to the other two electrodes 14 correspondingly. It should be noted that only FIG. 3 shows the first winding end 164 and the second winding end 184 and the other figures are simplified to ignore the first winding end 164 and the second winding end 184.

In this embodiment, the central hole 100 of the first core 10 has a plurality of first recess structures 102 and each of the two flanges 120 of the second core 12 has a plurality of second recess structures 126, wherein the first recess structures 102 are corresponding to the second recess structures 126. Accordingly, the first winding end 164 of the inner winding 16 and the second winding end 184 of the outer winding 18 can be pulled out through the first recess structures 102 and the second recess structures 126 and then be extended in a tangent direction of the pillar 122 of the second core 12. Then, the first winding end 164 of the inner winding 16 and the second winding end 184 of the outer winding 18 can be electrically connected to the first platforms 140 of the electrodes 14 correspondingly and easily.

Accordingly, the invention can automatize the process of manufacturing the transformer 1 and reduce the manufacturing cost.

In this embodiment, a third thickness T3 of the second platform 142 of the electrode 14 may be larger than or equal to the outer diameter D2 of the outer winding 18 and the outer diameter D1 of the inner winding 16 (i.e. T3>D2 and T3>D1), such that the outer winding 18 will not exceed the electrode 14. It should be noted that since the outer diameter D1 of the inner winding 16 is smaller than the outer diameter D2 of the outer winding 18 (i.e. D1<D2) for heat dissipation, the inner winding 16 will not exceed the electrode 14 either. Accordingly, when the transformer 1 is mounted on a circuit board (not shown) through the electrodes 14, the first winding end 164 of the inner winding 16 and the second winding end 184 of the outer winding 18 will not interfere with the circuit board. Furthermore, since the second platform 142 is higher than the first platform 140 and the first winding ends 164 of the inner winding 16 and the second winding ends 184 of the outer winding 18 are connected to the first platforms 140, the first winding ends 164 of the inner winding 16 and the second winding ends 184 of the outer winding 18 can be hidden below the second platforms 142, such that the flatness of the four electrodes 14 can be controlled effectively.

To manufacture the transformer 1, first of all, the inner winding 16 is wound around the pillar 122 and located in the winding space 124 of the second core 12. In practical applications, the inner winding 16 may be a circular or flat enameled wire. Then, the outer winding 18 is wound around the inner winding 16 and located in the winding space 124 of the second core 12. In practical applications, the outer winding 18 may be a circular or flat enameled wire. Then the second core 12 is disposed in the central hole 100 of the first core 10. In this time, a gap G exists between at least one of the two flanges 120 of the first core 10 and the central hole 100 of the second core 12. Then, the gap G is filled with an insulating and non-magnetic material (not shown), wherein the insulating material may be UV glue or other light-curable adhesives. Then, the insulating material is cured by UV light or heating. Then, the first winding end 164 of the inner winding 16 and the second winding end 184 of the outer winding 18 are fixed on the electrodes 14 by a spot welding process, a hot pressure welding process or other processes. Then, the insulating material is fully cured, so as to finish manufacturing the transformer 1.

Figure 5:
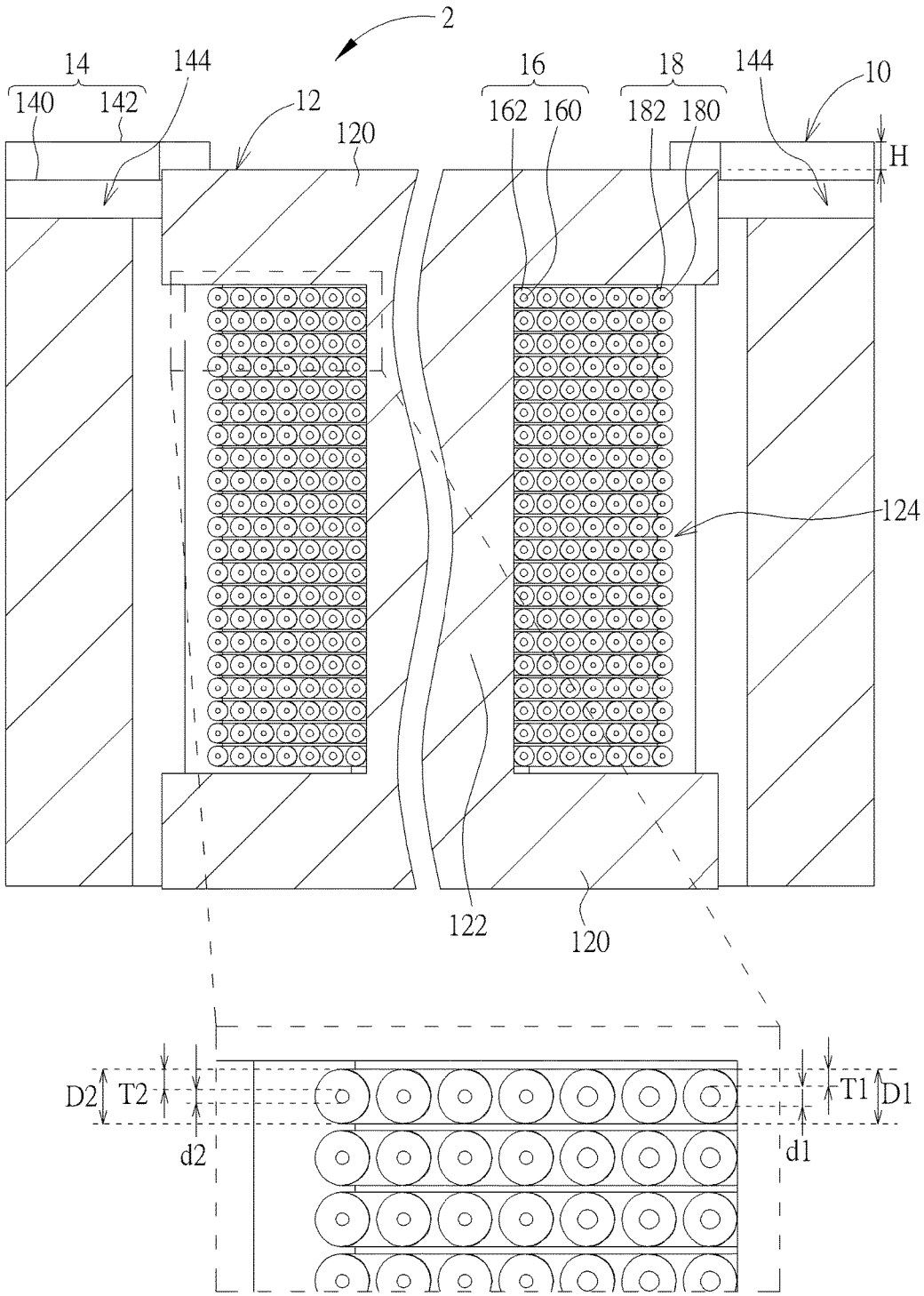
FIG. 5 is a sectional view illustrating a transformer according to another embodiment of the invention.

Referring to FIG. 5, FIG. 5 is a sectional view illustrating a transformer 2 according to another embodiment of the invention. The main difference between the transformer 2 and the aforesaid transformer 1 is that, in the transformer 2, the outer diameter D2 of the outer winding 18 is identical to the outer diameter D1 of the inner winding 16 (i.e. D2=D1), as shown in FIG. 5. Since the second thickness T2 of the second insulating layer 182 of the outer winding 18 is larger than first thickness T1 of the first insulating layer 162 of the inner winding 16 (i.e. T2>T1), the outer diameter d2 of the second wire 180 of the outer winding 18 is smaller than the outer diameter d1 of the first wire 160 of the inner winding 16 (i.e. d2<d1).

Figure 6:
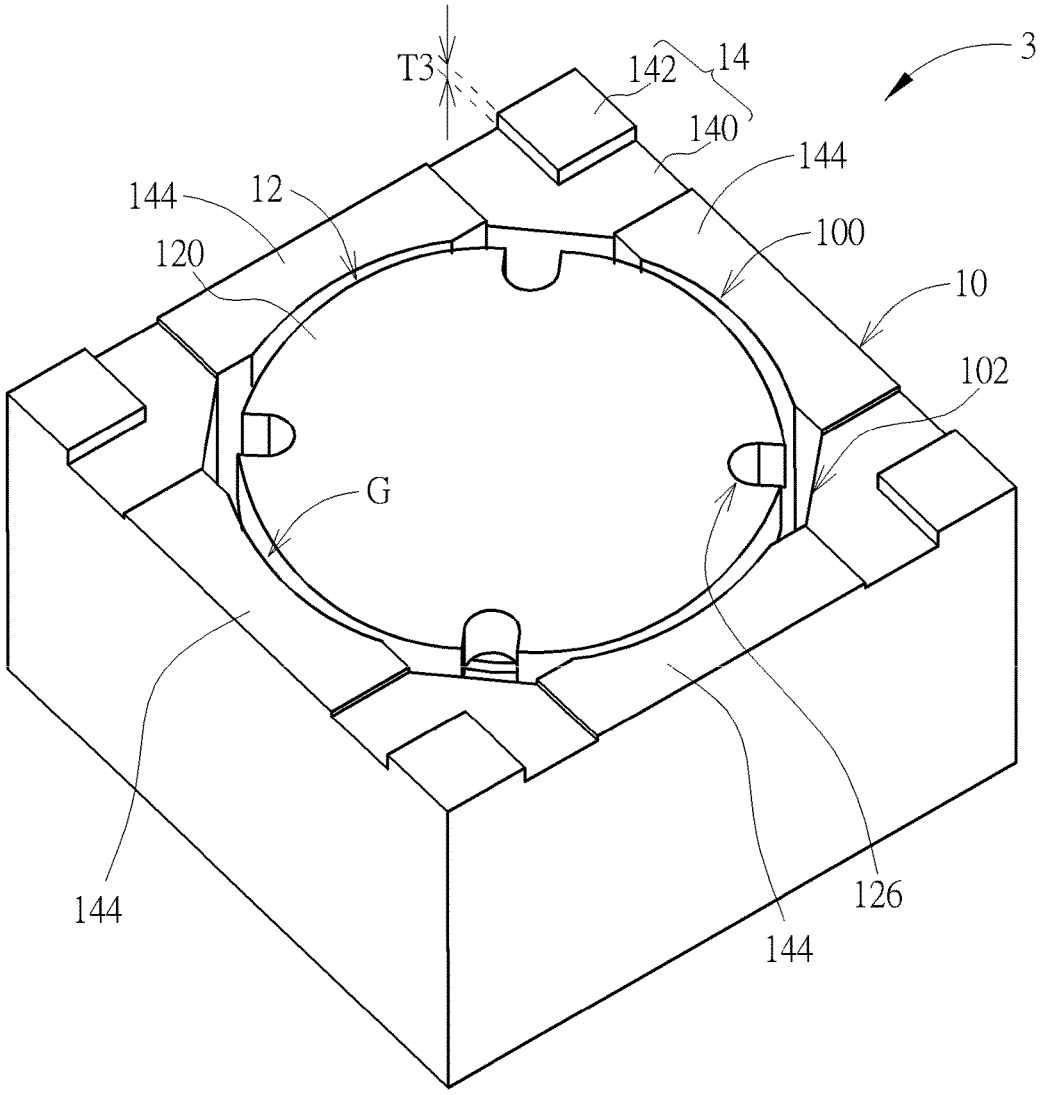
FIG. 6 is a perspective view illustrating a transformer according to another embodiment of the invention.

Referring to FIG. 6, FIG. 6 is a perspective view illustrating a transformer 3 according to another embodiment of the invention. The main difference between the transformer 3 and the aforesaid transformer 1 is that the separation structure 144 of the transformer 3 is a protruding structure, as shown in FIG. 6. In this embodiment, the second platform 142 is higher than the separation structure 144 and the separation structure 144 is higher than the first platform 140.

Figure 7:
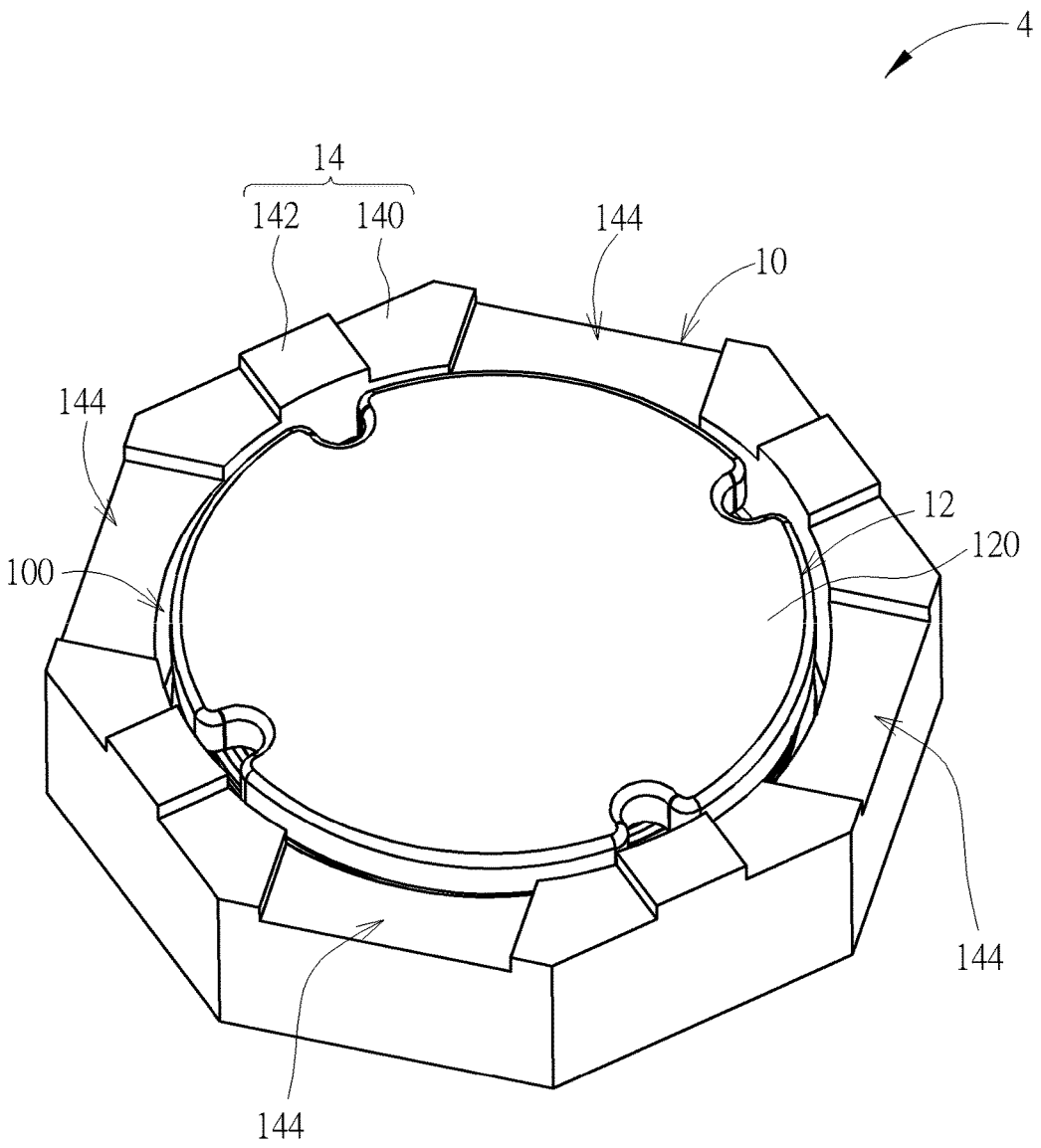
FIG. 7 is a perspective view illustrating a transformer according to another embodiment of the invention.

Referring to FIG. 7, FIG. 7 is a perspective view illustrating a transformer 4 according to another embodiment of the invention. The main difference between the transformer 4 and the aforesaid transformer 1 is that the first core 10 of the transformer 4 is octagon, as shown in FIG. 7. In this embodiment, the second platform 142 of the electrode 14 is located at the middle of the first platform 140 of the electrode 14.

Figure 8:
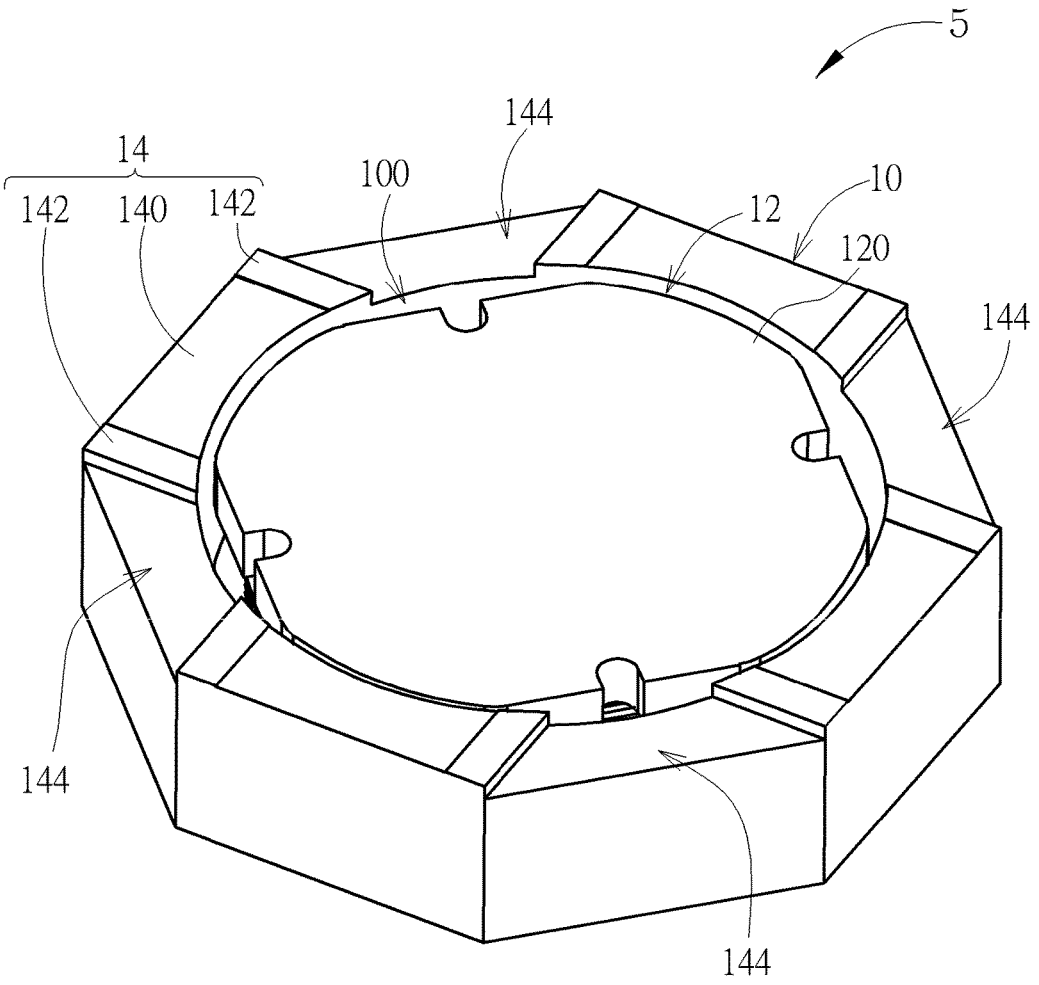
FIG. 8 is a perspective view illustrating a transformer according to another embodiment of the invention.

Referring to FIG. 8, FIG. 8 is a perspective view illustrating a transformer 5 according to another embodiment of the invention. The main difference between the transformer 5 and the aforesaid transformer 1 is that the first core 10 of the transformer 5 is octagon, as shown in FIG. 7. In this embodiment, the electrode 14 has two second platforms 142, wherein the two second platforms 142 of the electrode 14 are located at opposite sides of the first platform 140 of the electrode 14.

Figure 9:
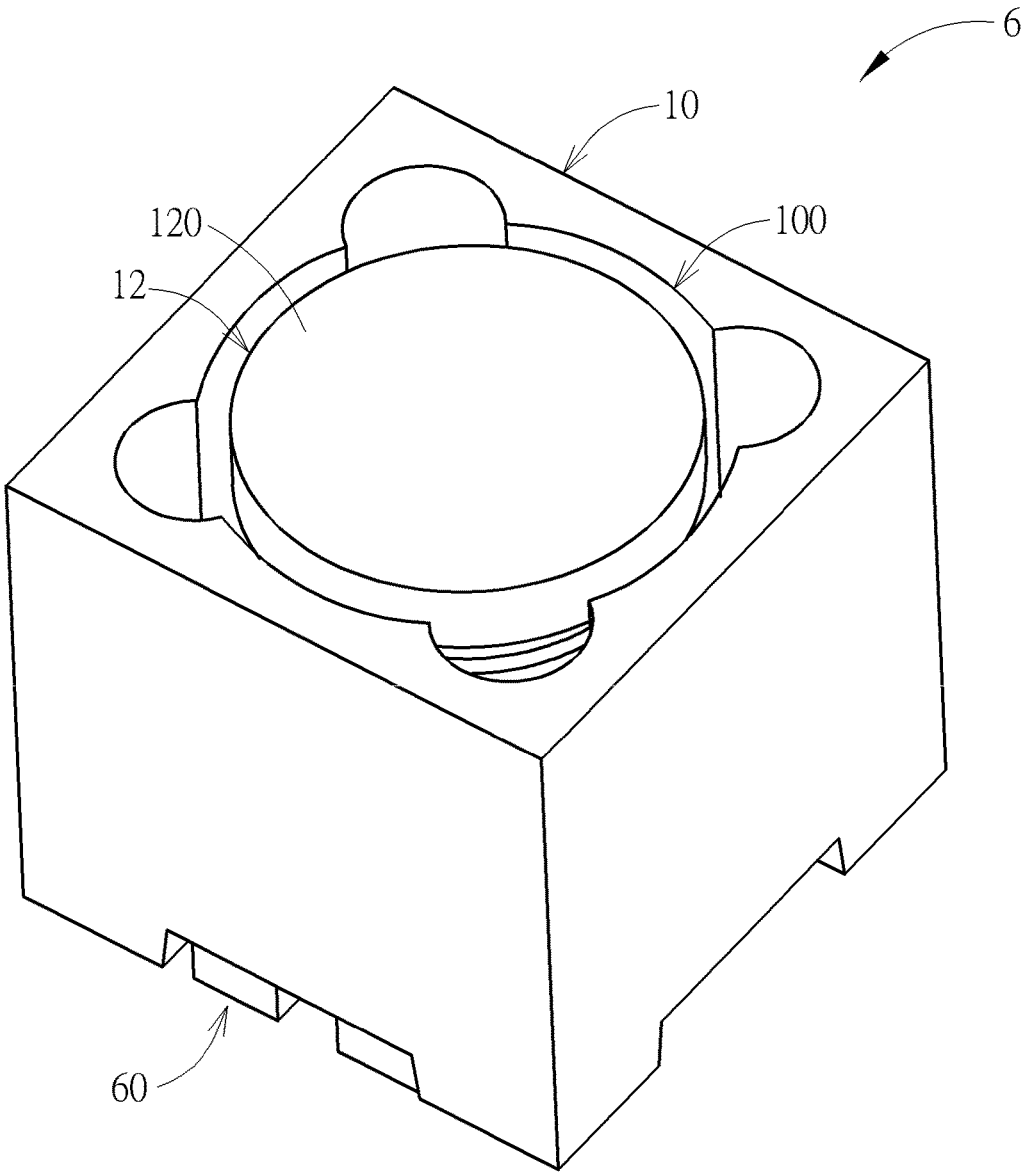
FIG. 9 is a perspective view illustrating a transformer according to another embodiment of the invention.
Figure 10:
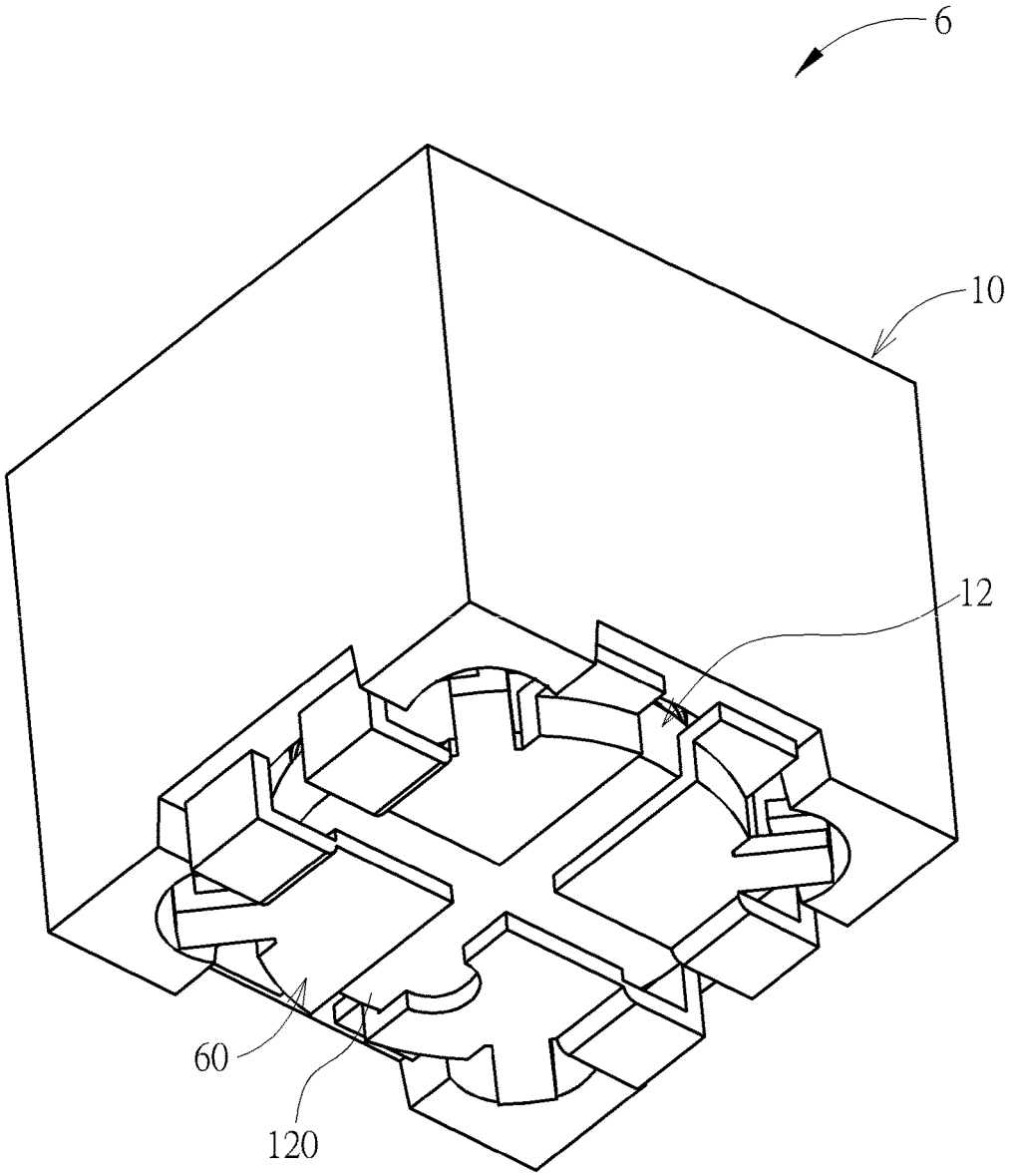
FIG. 10 is a perspective view illustrating the transformer shown in FIG. 9 from another viewing angle.
Figure 11:
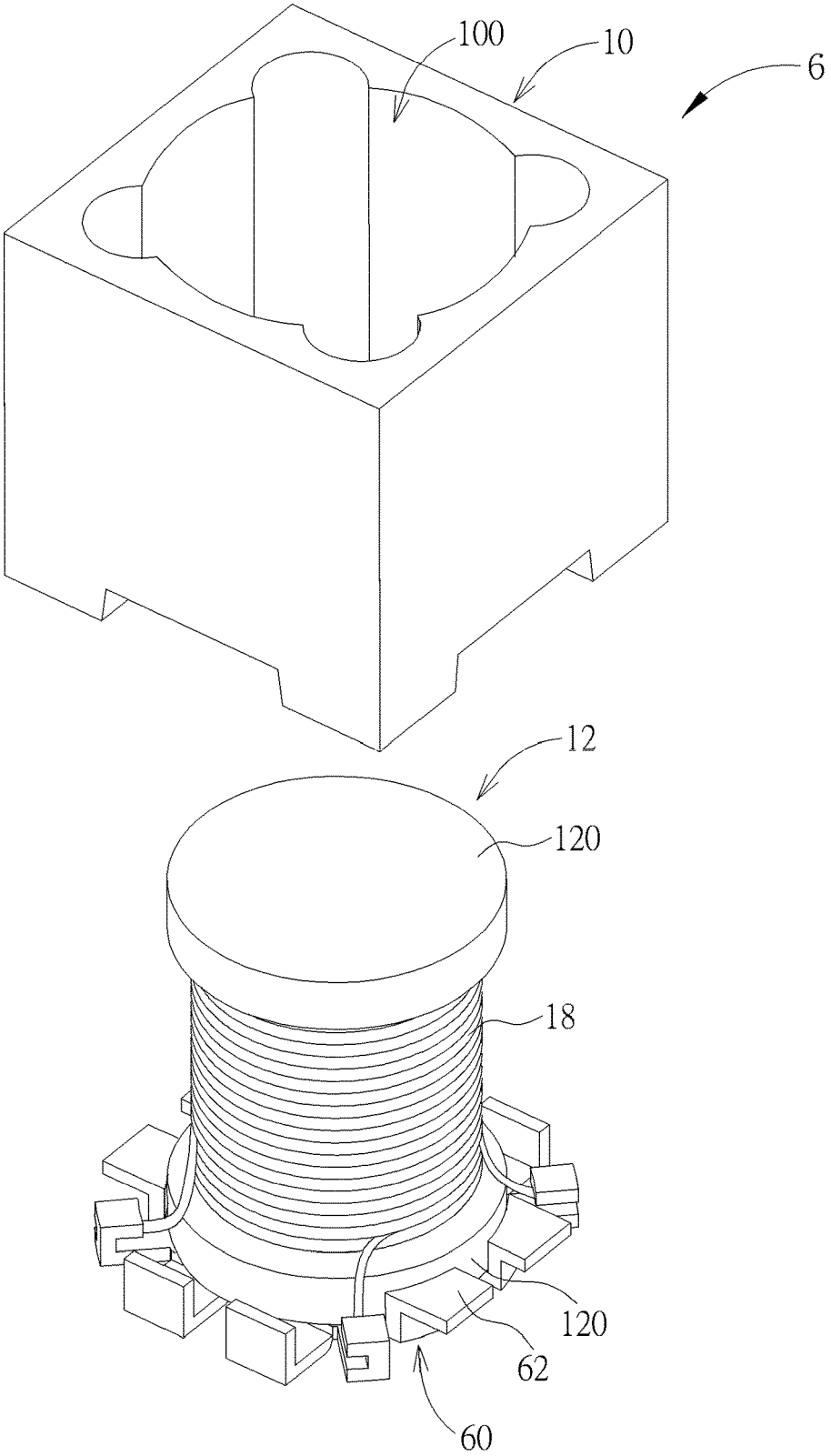
FIG. 11 is an exploded view illustrating the transformer shown in FIG. 9.
Figure 12:
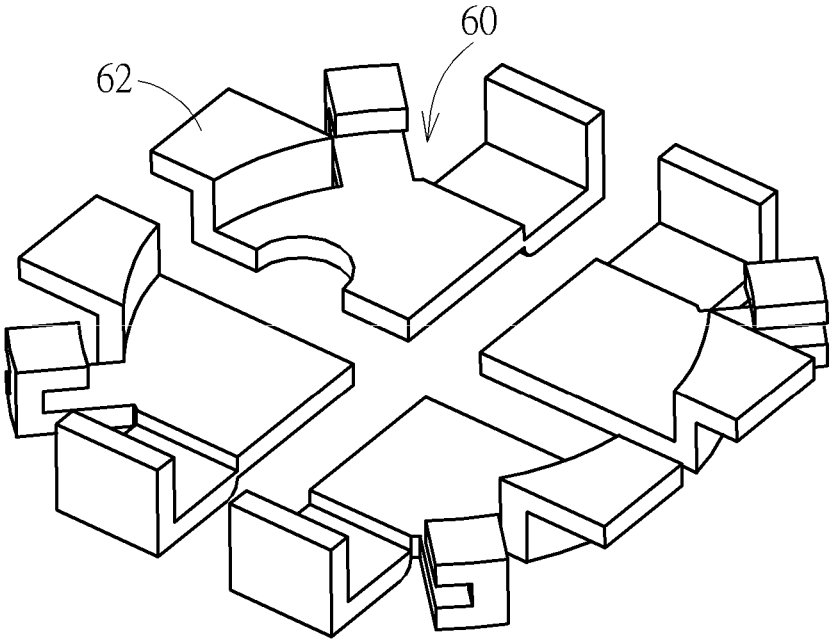
FIG. 12 is a perspective view illustrating the lead frame shown in FIG. 11.

Referring to FIGS. 9 to 12, FIG. 9 is a perspective view illustrating a transformer 6 according to another embodiment of the invention, FIG. 10 is a perspective view illustrating the transformer 6 shown in FIG. 9 from another viewing angle, FIG. 11 is an exploded view illustrating the transformer 6 shown in FIG. 9, and FIG. 12 is a perspective view illustrating the lead frame 60 shown in FIG. 11.

The main difference between the transformer 6 and the aforesaid transformer 1 is that the transformer 6 further comprises a lead frame 60 disposed on one of the two flanges 120 of the second core 12, as shown in FIGS. 9 to 12. In this embodiment, the lead frame 60 provides a plurality of electrodes 62, wherein the aforesaid electrodes 14 are replaced by the electrodes 62. Therefore, according to the embodiments shown in FIGS. 1 and 11, the electrodes of the invention may be selectively disposed on one of the first core 10 and the second core 12.

As mentioned in the above, since the second thickness of the second insulating layer of the outer winding is larger than the first thickness of the first insulating layer of the inner winding, a withstand voltage of the transformer can be increased effectively by increasing the second thickness of the second insulating layer of the outer winding, so as to avoid generating a flash over between the inner winding and the outer winding. Furthermore, since the invention increases the withstand voltage of the transformer by increasing the second thickness of the second insulating layer of the outer winding, the invention can maintain the volume of the transformer without disposing an insulating tape between the inner winding and the outer winding, such that the process of manufacturing the transformer can be simplified and the manufacturing cost can be reduced. Moreover, since there is no insulating tape disposed between the inner winding and the outer winding, the winding space can be saved for the inner winding and the outer winding, so as to keep flexibility in designing a characteristic of the transformer. In some embodiments, when the transformer of the invention is applied to an electronic product with high voltage, the invention may selectively disposed the insulating tape between the inner winding and the outer winding, so as to further increase the withstand voltage of the transformer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A transformer comprising:

a first core having a central hole;

a second core disposed in the central hole, the second core having two flanges and a pillar located between the two flanges, a winding space being located among the two flanges and the pillar;

a plurality of electrodes disposed on the first core, each of the electrodes having a first platform and a second platform higher than the first platform, the first platform being protruded from a surface of the first core, the second platform being protruded from the first platform;

an inner winding wound around the pillar and located in the winding space, a first winding end of the inner winding being electrically connected to one of the electrodes, the inner winding comprising a first wire and a first insulating layer covering the first wire; and an outer winding wound around the inner winding and located in the winding space, a second winding end of the outer winding being electrically connected to one of the electrodes, the outer winding comprising a second wire and a second insulating layer covering the second wire, second thickness of the second insulating layer being larger than first thickness of the first insulating layer.

2. The transformer of claim 1, wherein the first core is an SRI core and the second core is a drum core.

3. The transformer of claim 1, wherein the first winding end of the inner winding and the second winding end of the outer winding are extended in a tangent direction of the pillar of the second core.

4. The transformer of claim 1, wherein the second platform is a highest structure of the transformer, the second platform is higher than the flange, and a height difference exists between the second platform and the flange.

5. The transformer of claim 1, wherein the first platform is disposed at an edge of the second platform and at least one conducting layer is formed on surfaces of the first platform and the second platform.

6. The transformer of claim 1, wherein the first winding end of the inner winding and the second winding end of the outer winding are electrically connected to the first platforms of the electrodes correspondingly and third thickness of the second platform is larger than or equal to an outer diameter of the outer winding and the inner winding.

7. The transformer of claim 1, wherein a separation structure exists between two adjacent electrodes to separate the two adjacent electrodes.

8. The transformer of claim 7, wherein the separation structure is a recess structure, the second platform is higher than the first platform, and the first platform is higher than the separation structure.

9. The transformer of claim 7, wherein the separation structure is a protruding structure, the second platform is higher than the separation structure, and the separation structure is higher than the first platform.

10. The transformer of claim 7, wherein the separation structure is lower than the first platform and the second platform.

11. The transformer of claim 1, wherein the central hole of the first core has a plurality of first recess structures, each of the two flanges has a plurality of second recess structures, and the first recess structures are corresponding to the second recess structures.

12. The transformer of claim 1, wherein a gap exists between the first core and at least one of the two flanges of the second core and is filled with an insulating and non-magnetic material.

13. The transformer of claim 1, wherein the electrodes are disposed on corners of the first core.

* * * * *